US007287410B2

(12) United States Patent
King

(10) Patent No.: US 7,287,410 B2
(45) Date of Patent: Oct. 30, 2007

(54) AUTOMOBILE DAMAGE REPAIRING MACHINE

(76) Inventor: Jerry A. King, 1712 N. Broadway, Wichita, KS (US) 67214

( * ) Notice: Subject to any disclaimer, the term of this patent is extended or adjusted under 35 U.S.C. 154(b) by 0 days.

(21) Appl. No.: 11/346,070

(22) Filed: Feb. 2, 2006

(65) Prior Publication Data

US 2007/0175263 A1 Aug. 2, 2007

(51) Int. Cl.
*B21J 13/08* (2006.01)

(52) U.S. Cl. ..... 72/457; 72/305; 72/705

(58) Field of Classification Search ..... 72/305, 72/311, 453.01, 457, 458, 705
See application file for complete search history.

(56) References Cited

U.S. PATENT DOCUMENTS 5,031,438 A * 7/1991 Flannery ..... 72/305
5,156,037 A * 10/1992 Bundy ..... 72/422
5,819,576 A * 10/1998 Smith, Jr. ..... 72/311
6,182,493 B1 * 2/2001 Weschler ..... 72/457
6,484,554 B2 * 11/2002 Soyk ..... 72/447

* cited by examiner

*Primary Examiner*—Ed Tolan
(74) *Attorney, Agent, or Firm*—Kenneth H. Jack; Davis & Jack, L.L.C.

(57) ABSTRACT

An automobile body repair machine incorporating a quill and shaft load shouldering assembly whose quill includes lateral, medial, and oppositely lateral sections; slide stopping set screws extending through the quill sections for impingement upon the quill and shaft combination's shaft; weld seam grasping left and right anchor clamps fixedly attached to the lateral and oppositely lateral quill sections; a pull force transferring cantilevered stem; a selectively lockable and unlockable pivot joint interconnecting the stem and the medial quill section; a pivoting cantilevered foot attached to a distal end of the stem; and a foot extending hydraulic cylinder triangulating between the stem and the foot; the automobile body repairing machine further incorporating a body damage pulling tie attached to a distal end of the cantilevered foot.

12 Claims, 10 Drawing Sheets

AUTOMOBILE DAMAGE REPAIRING MACHINE

FIELD OF THE INVENTION

This invention relates to apparatus and machinery which is specially configured and adapted for assisting auto body repair persons in their performance of auto body work. More particularly, this invention is related to such machinery which is adapted for performing controlled body pulls for reforming damaged or deformed automobile bodies to their original undamaged configurations.

BACKGROUND OF THE INVENTION

Known machinery and apparatus for performing progressive pulls for repairing and restoring automobile body damage is typically mechanically complex, is bulky and unwieldy, and is not economically fabricated and used.

The instant inventive automobile body damage repairing machine overcomes such drawbacks and deficiencies of prior art machines by providing a mechanically simple and compact assembly, such assembly beneficially incorporating a pulling force load shouldering structure which comprises a segmented quill and shaft assembly.

BRIEF SUMMARY OF THE INVENTION

A major structural component of the instant inventive automobile body damage repairing machine preferably comprises a pulling force load shouldering quill and shaft assembly. The shaft of the preferred quill and shaft assembly comprises a single or unitary length of rectangular steel tubing. Preferably, the cross-sectional dimensions of such length of rectangular tubing are 1½" by 3½", such tubing preferably having a ¼" wall thickness. Preferably, such rectangular tubing shaft has a length sufficient to span between and underlie the "hard point" weld seams of an automobile "uni-body" frame, such seams commonly constituting the lowermost structure of such frame.

The quill component of the quill and shaft assembly preferably is segmented, comprising separately slidable medial, lateral, and oppositely lateral sections. Each such slide section or quill segment preferably forms a closely fitted slide sleeve having inside cross-sectional dimensions matching the outside cross-sectional dimensions of the shaft element. Suitably, such slide sleeves may alternately comprise an open frame defining a hollow lateral bore.

Lateral and oppositely lateral anchor clamps are preferably provided, the lateral and oppositely lateral quill sections constituting preferred means for movably mounting such clamps upon the shaft element. Suitably, though less desirably, the laterally opposite quill section may be eliminated, and substitute sessile means for interconnecting the laterally opposite anchor clamp and the shaft may be provided. Suitably, means such as welding or fixed bolted attachments may interconnect the shaft and the laterally opposite anchor clamp in such alternate sessile configuration.

The medial quill section is preferably similarly slidably mounted over the shaft and is positioned between the lateral and laterally opposite anchor clamps and between their lateral and preferred laterally opposite quill section attaching means. Such medial quill section preferably supports and forms pivotal attaching means, such means attaching a proximal end of a cantilevered pulling force transmitting stem to the shaft of the preferred quill and shaft assembly.

In operation, the medial, lateral, and preferred laterally opposite quill sections may be slidably and selectively positioned along the length of the shaft, such selective positioning advantageously allowing an operator to fit and attach the assembly to a particular vehicle's weld seams and to establish a mechanically advantageous anchor point for a desired body straightening progressive pull.

The lateral and oppositely lateral anchor clamps preferably comprise jaw plate clamps which are specially adapted for attachment to under surfaces of common automobile uni-body frames. Such frames commonly present left and right longitudinally and downwardly extending flange-like "hard point" weld seams. The anchor clamps are preferably adapted for compressively grasping such hard point weld seams. Where the requisite anchor clamps must be engage a frame structure of a vehicle having "C" channel chassis beams, the laterally inward jaws of the anchor clamps are preferably adapted to upwardly and outwardly span over the lower flanges of such chassis beams to reach and to clamp against such beams' vertically extending webs.

In order to releasably secure the lateral, preferred oppositely lateral, and medial quill sections at desired selected positions along the length of the shaft, slide stopping means are preferably provided, such means being operatively connected to such quill sections. In a preferred embodiment, the slide stopping means comprises helically threaded set screws which are threadedly mounted within helically threaded apertures extending through the walls of the quill sections. Pressurized impingement of inner ends of such set screws upon the underlying shaft advantageously releasably stops the quill sections in desired locations. Suitably, though less desirably, the slide stopping means may alternately comprise shear pin and aligned eyes combinations, or may alternately comprise pressure clamping assemblies.

The stem element of the instant inventive automobile body repair machine preferably comprises a telescoping square tubing aluminum shaft, such shaft cantilevering distally from the medial quill section's pivotal attaching means. Such pivotal attaching means preferably comprises a pin, eye, and clevis joint which extends distally from the medial quill section. Where such preferred pin, eye, and clevis pivotal attaching means is provided, upper and lower ear plates of the clevis preferably present radially arrayed negative detents for engaging positive detents or lugs extending from the stem. Selective engagement of such lugs with detents among such radial array of negative detents advantageously secures the stem in a desired angular position with respect to the load shouldering quill and shaft assembly. Suitably, the orientation of the detents may be reversed, with positive detents being radially arrayed and with a singular negative detent supported upon the stem.

A pivoting and upwardly cantilevered foot is preferably attached to the distal end of the preferred telescoping stem, and foot extension means triangulating between the stem and the foot are preferably provided. Preferably, the foot extension mean comprises a hydraulic cylinder. In accordance with a preferred embodiment of the instant invention, a body damage pulling tie, such as a heavy chain and hook is fixedly attached to a distal or upper end of the cantilevered foot. Various body pulling attachment implements known in the body work arts may be attached to such hook.

In operation of the inventive automobile body repair machine, and assuming the provision of preferred structures as described above, and also assuming utilization of the machine for repair of damage to a four door sedan's center door post, the load shouldering quill and shaft assembly of the inventive assembly may initially be placed upon a garage floor surface immediately underlying such sedan's left and right "hard point" uni-body weld seams. Preferably, the assembly is longitudinally oriented at a point immediately rearward of the sedan's center door post. Also preferably, upon such positioning, the machine's preferred telescoping stem is pivotally moved to extend from beneath the sedan, toward and distally beyond the sedan's damaged center door post. Thereafter, the machine's lateral and oppositely lateral anchor clamps are fixedly engaged with the sedan's left and right weld seams. Thereafter, the lateral, medial, and oppositely lateral quill sections' slide stopping set screws are wrench turned to fixedly position each of those quill sections at desired positions along the shaft. Upon such mounting of the inventive machine's load shouldering quill and shaft assembly upon such sedan's uni-body frame, the machine's cantilevered body pulling foot, hydraulic cylinder, and body pull tie combination may be engaged with the damaged door post and may be manipulated for performing a series of controlled pulls upon such post in a manner conventionally known to those skilled in the art.

Accordingly, objects of the instant invention include the provision of an automobile body repair machine including and incorporating a load shouldering assembly comprising a segmented quill and shaft assembly, the segmented quill supporting a slidable positionable pivot joint and frame engaging anchor clamps.

Other and further objects, benefits, and advantages of the instant invention have been discussed above and will become known to those skilled in the art upon review of the Detailed Description and appended drawings which follow.

BRIEF DESCRIPTION OF THE DRAWINGS (Each of drawings FIGS. 1-10 is submitted informally)

Figure 3:
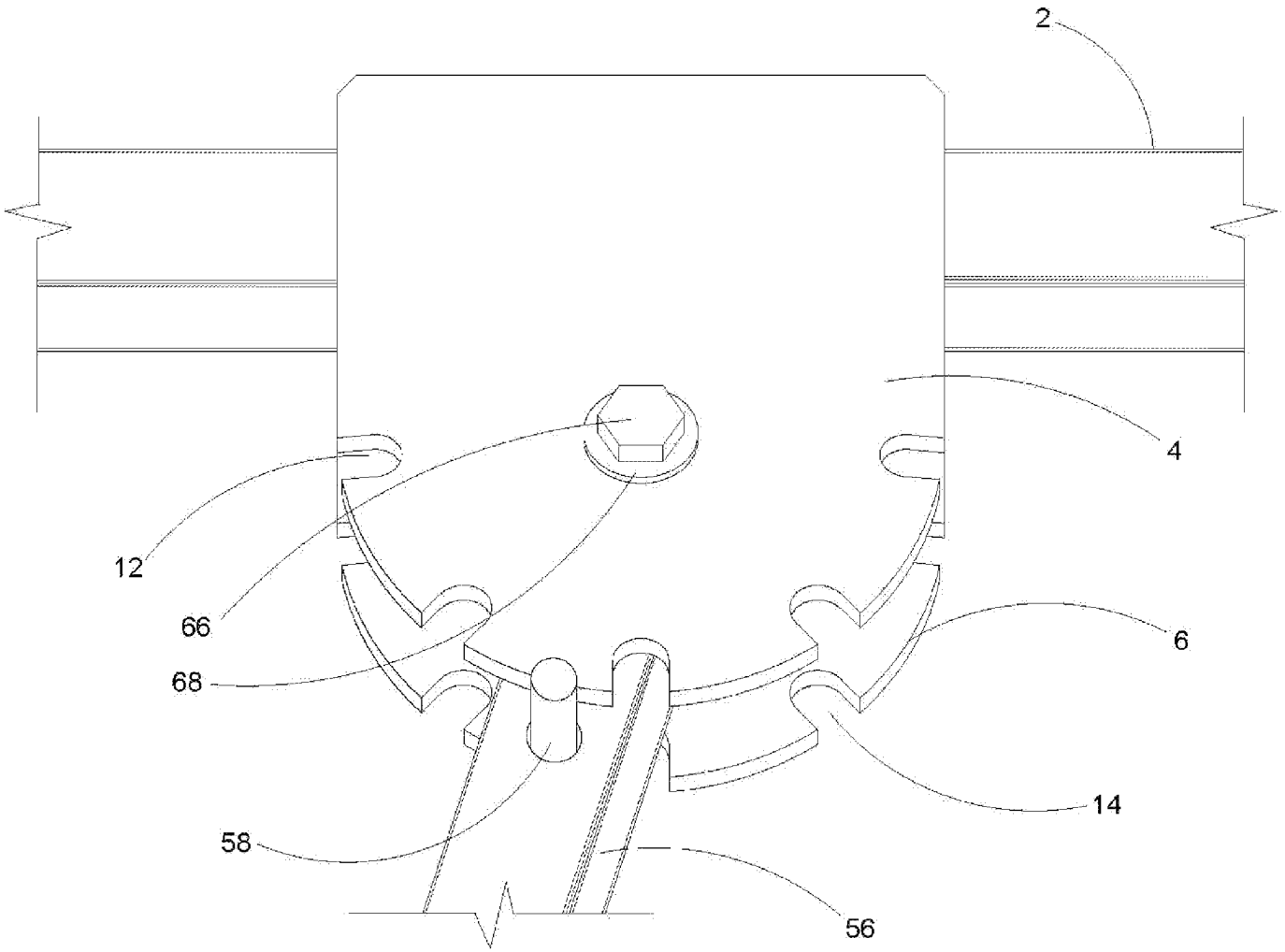
FIG. 3 is a partial plan/perspective view of the machine depicted in FIG. 1.
Figure 5:
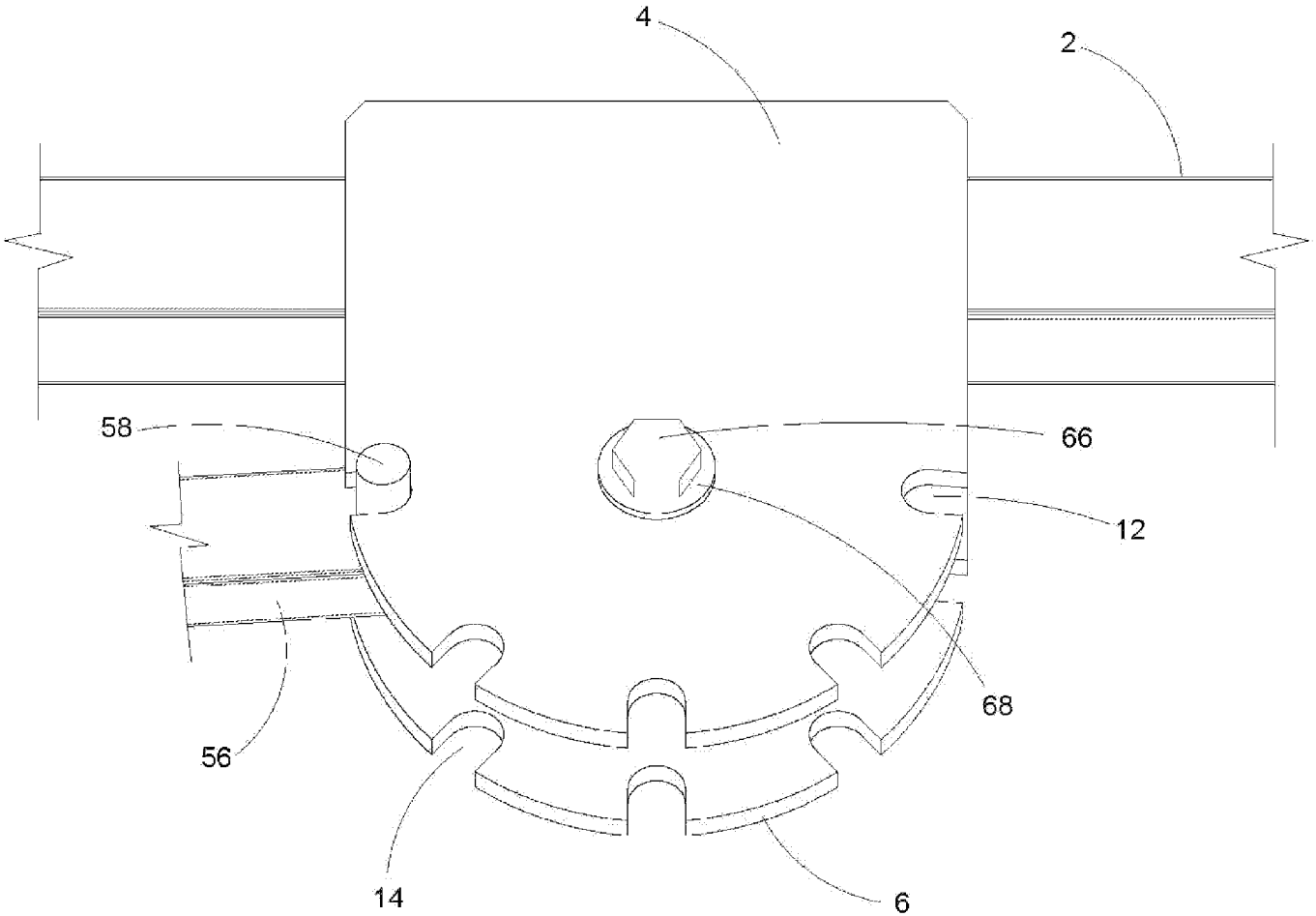

FIG. 5 redepicts the structure of FIG. 3, the view of FIG. 5 showing an alternate configuration of such structure.

Figure 1:
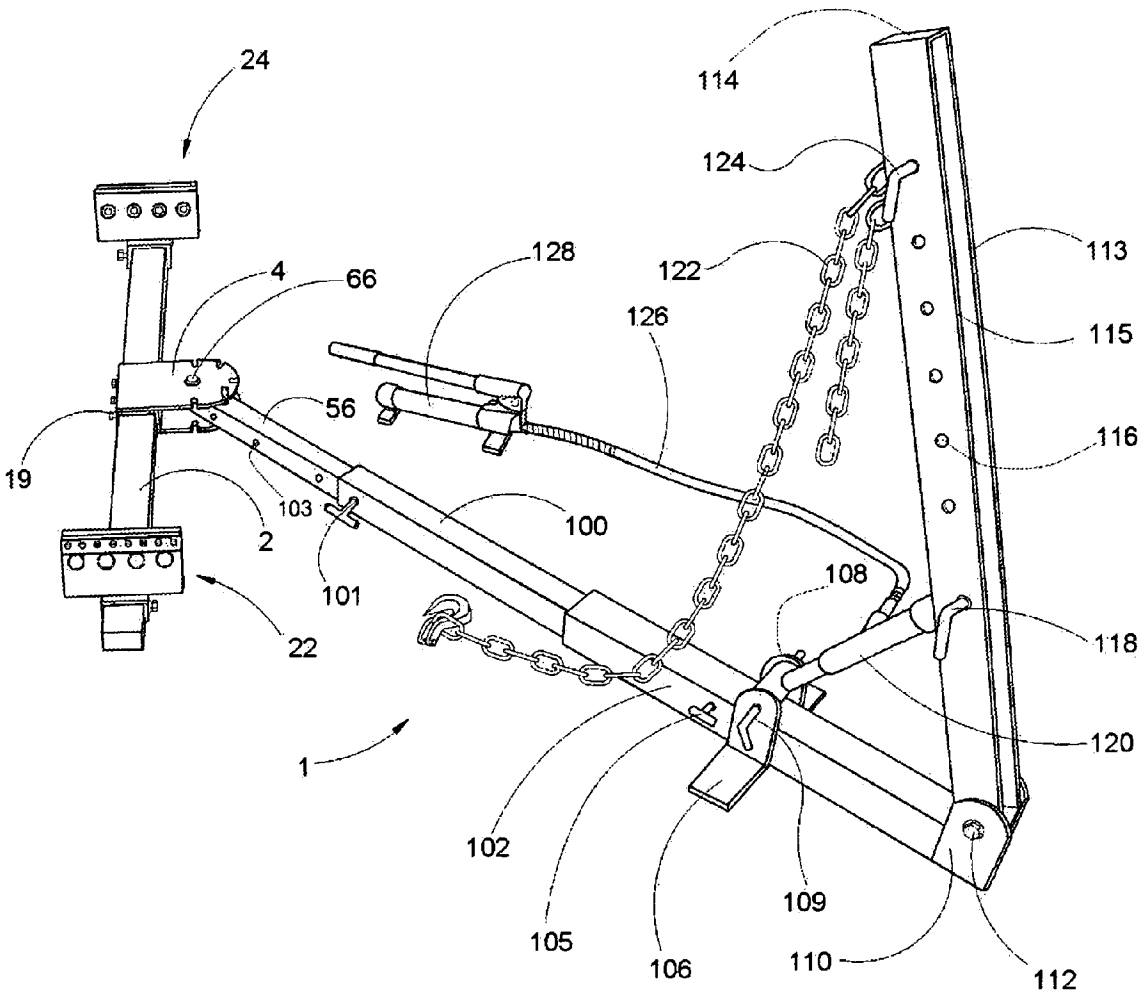
FIG. 1 is a perspective view of a preferred embodiment of the instant inventive automobile body repair machine.
Figure 6:
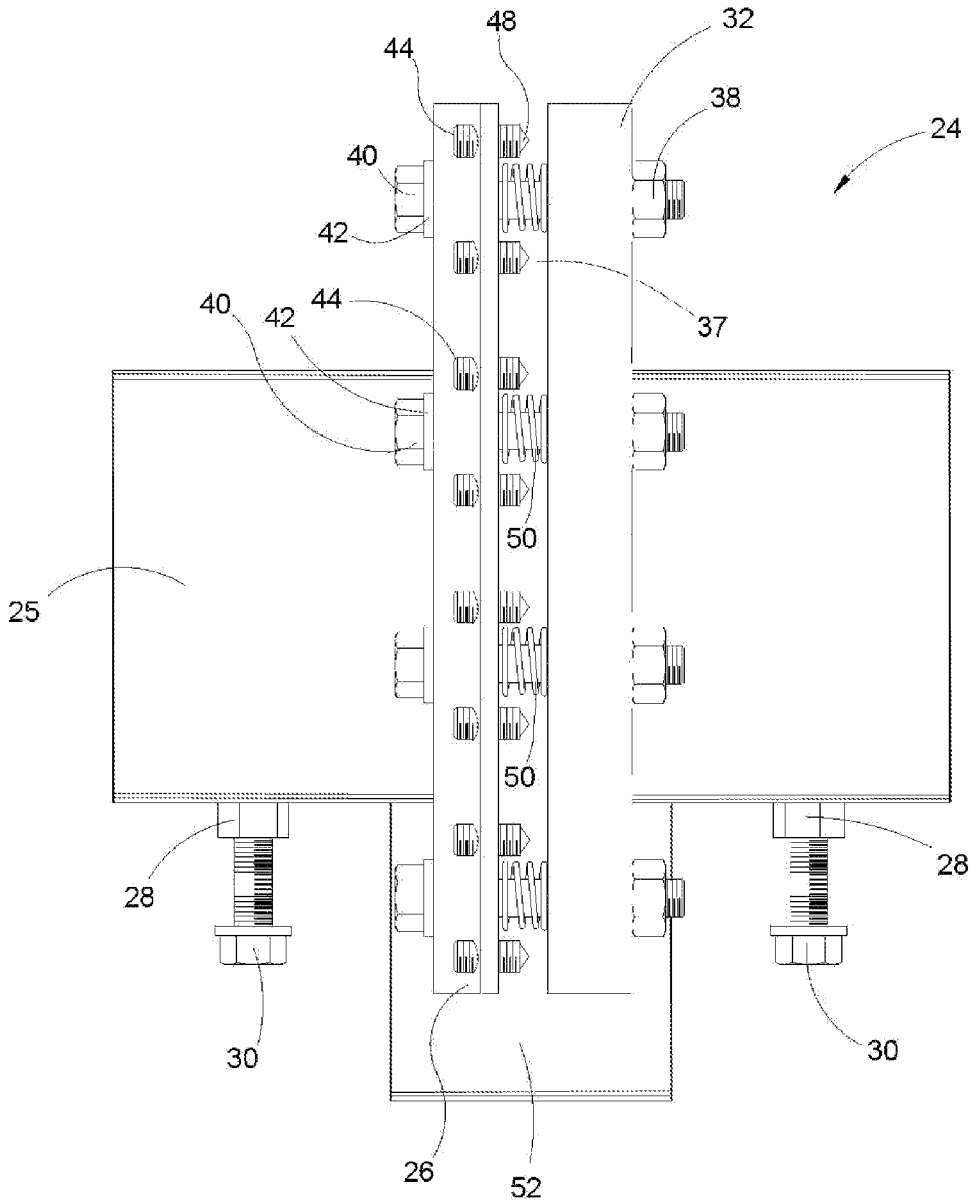

FIG. 6 depicts a disassembled lateral quill section and anchor clamp element of the machine depicted in FIG. 1.

Figure 7:
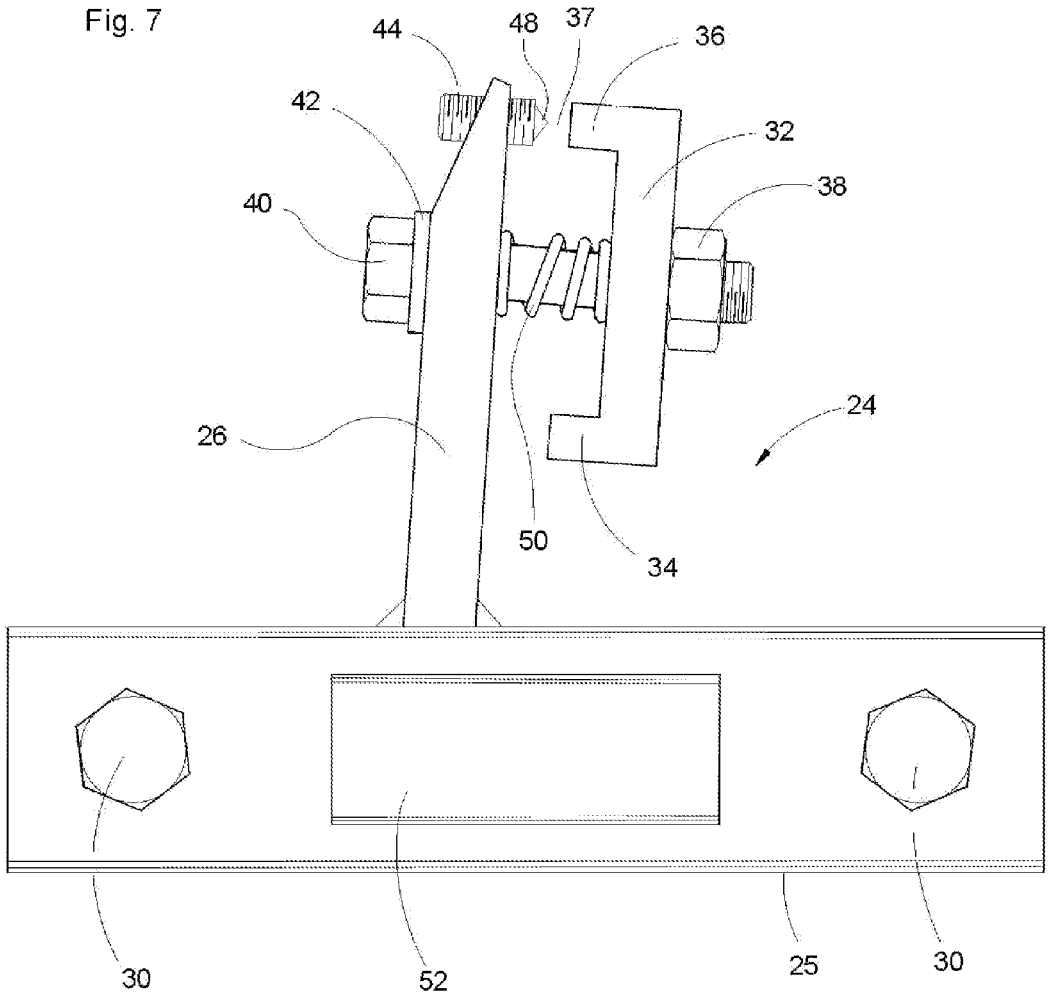

FIG. 7 is an end view of the structure depicted in FIG. 6.

Figure 8:
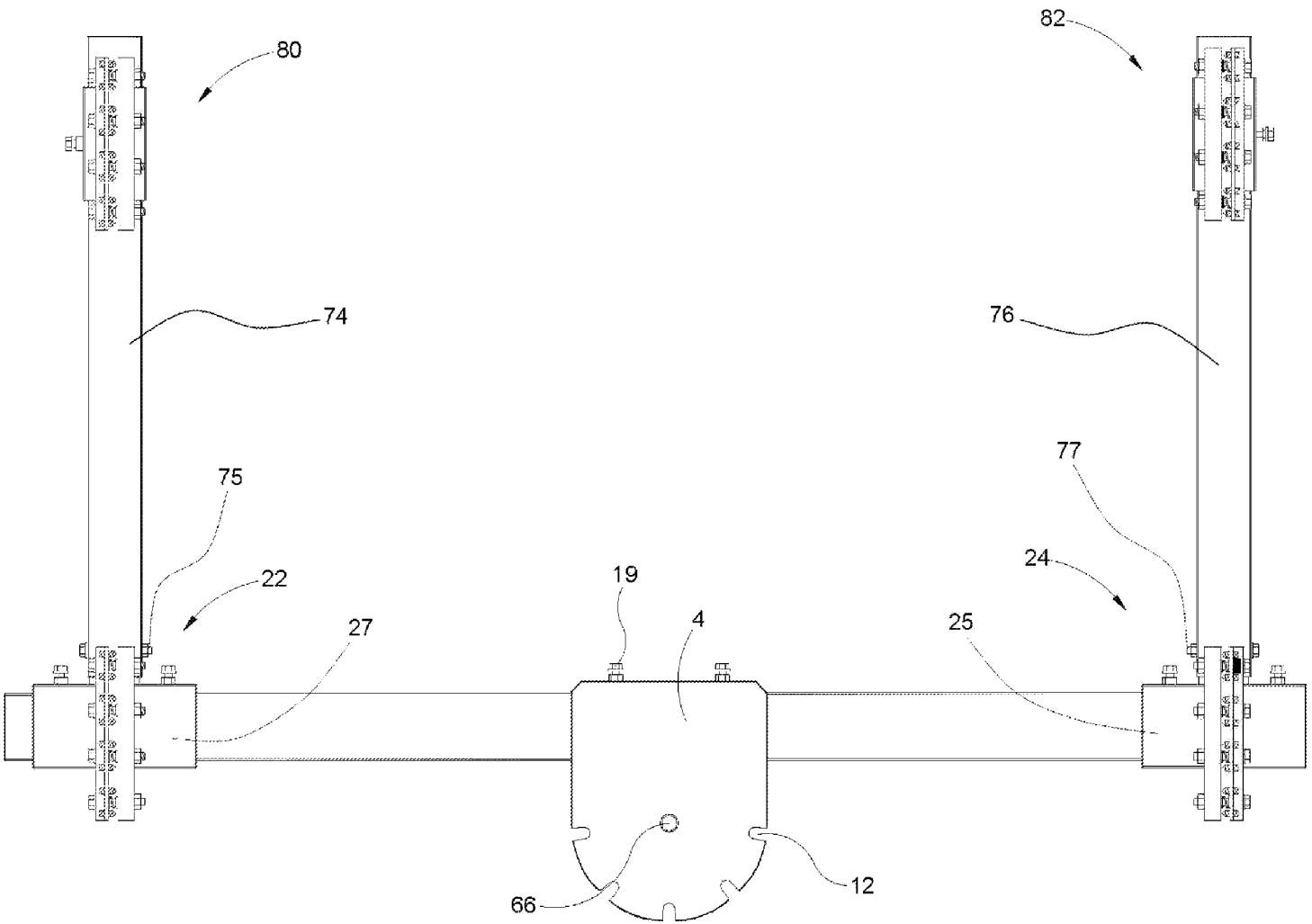

FIG. 8 depicts an alternate configuration of the instant inventive machine, such configuration additionally including lateral and oppositely lateral extension anchor clamps.

Figure 9:
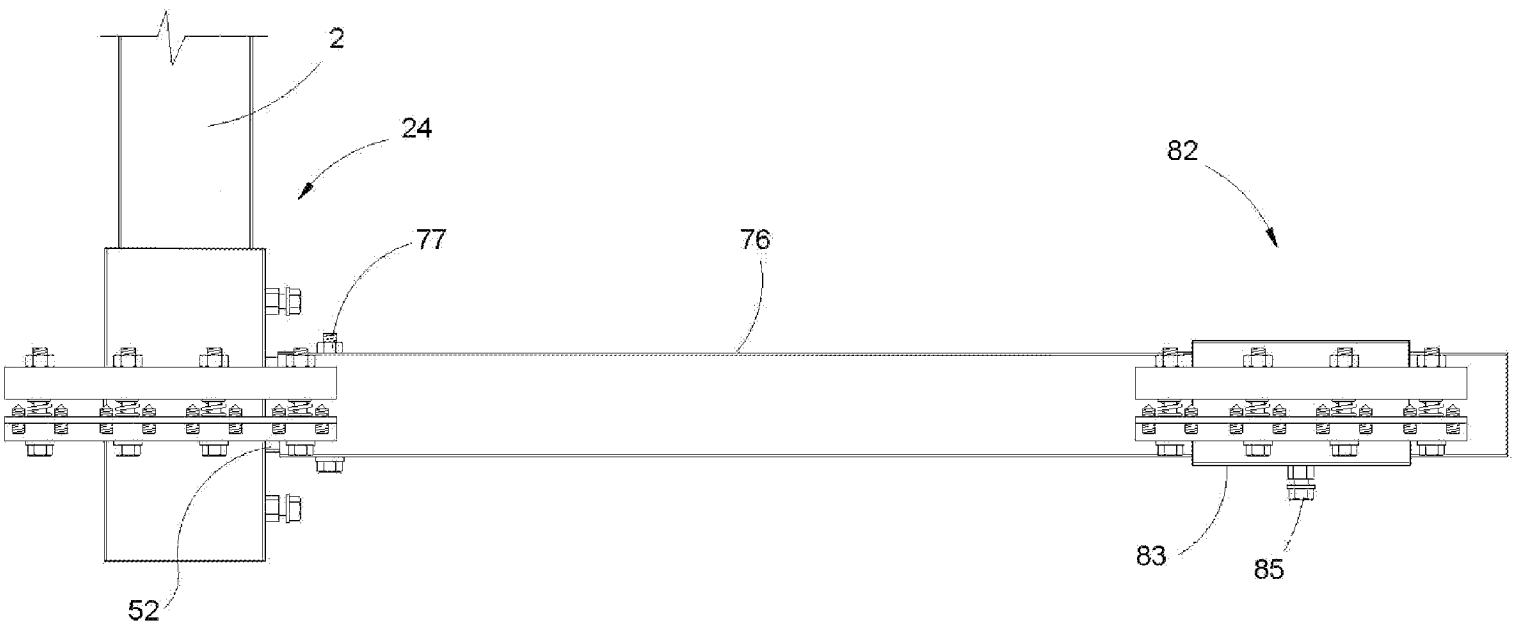

FIG. 9 is an alternate perspective view of the structure depicted in FIG. 8.

Figure 10:
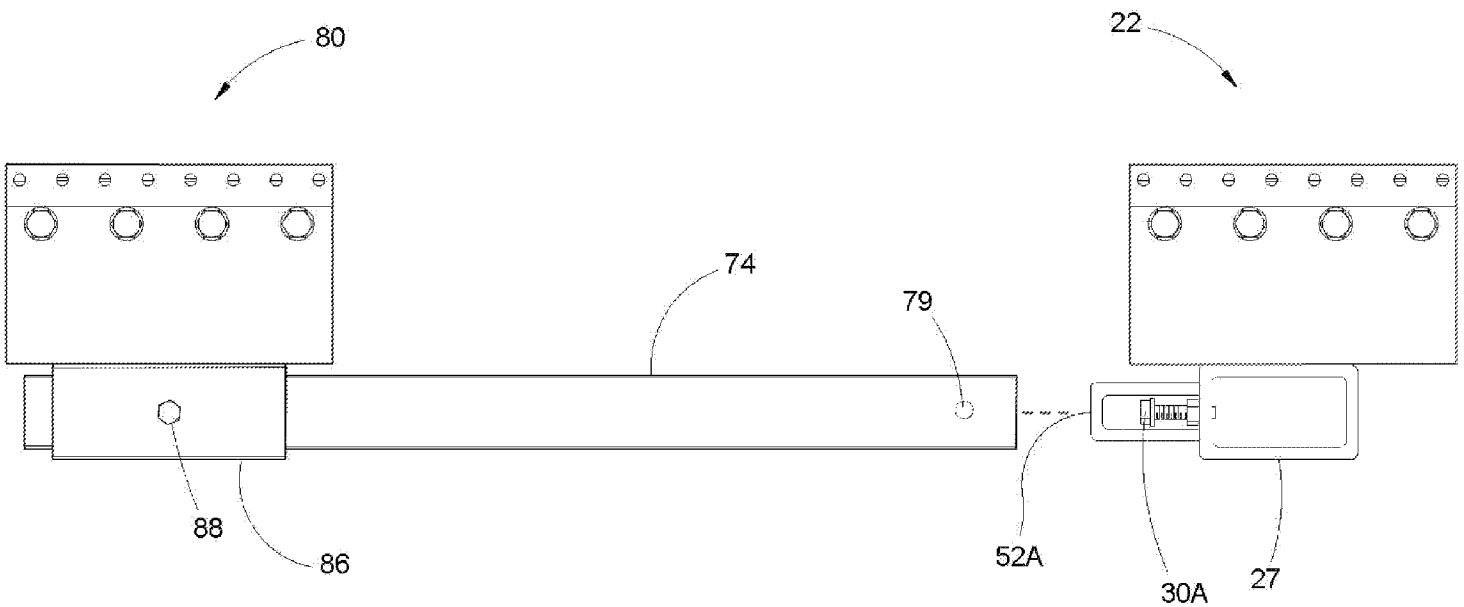

FIG. 10 shows disassembled lateral quill section, anchor clamp, and extension anchor clamp structures.

DETAILED DESCRIPTION OF A PREFERRED EMBODIMENT

Referring now to the drawings, and in particular to FIG. 1, a preferred embodiment of the instant inventive automobile body repair machine is referred to generally by Reference Arrow 1. The machine 1 preferably comprises a load or pull force shouldering quill and shaft assembly, the shaft of such assembly preferably comprising a laterally extending length of rectangular steel tubing 2. Referring further simultaneously to FIGS. 4, 6, 7, and 10, the quill of such quill and shaft assembly preferably is partitioned or segmented to include a medial quill section 8, a lateral quill section 25, and a laterally opposite quill section 27. The medial quill section 8 preferably has a laterally extending bore 10 which is closely fitted for sliding receipt of the shaft 2. The lateral and laterally opposite quill sections 25 and 27 preferably include laterally extending bores configured substantially identically to the bore 10 of the medial quill section 8, such bores similarly slidably receiving the shaft 2.

Figure 4:
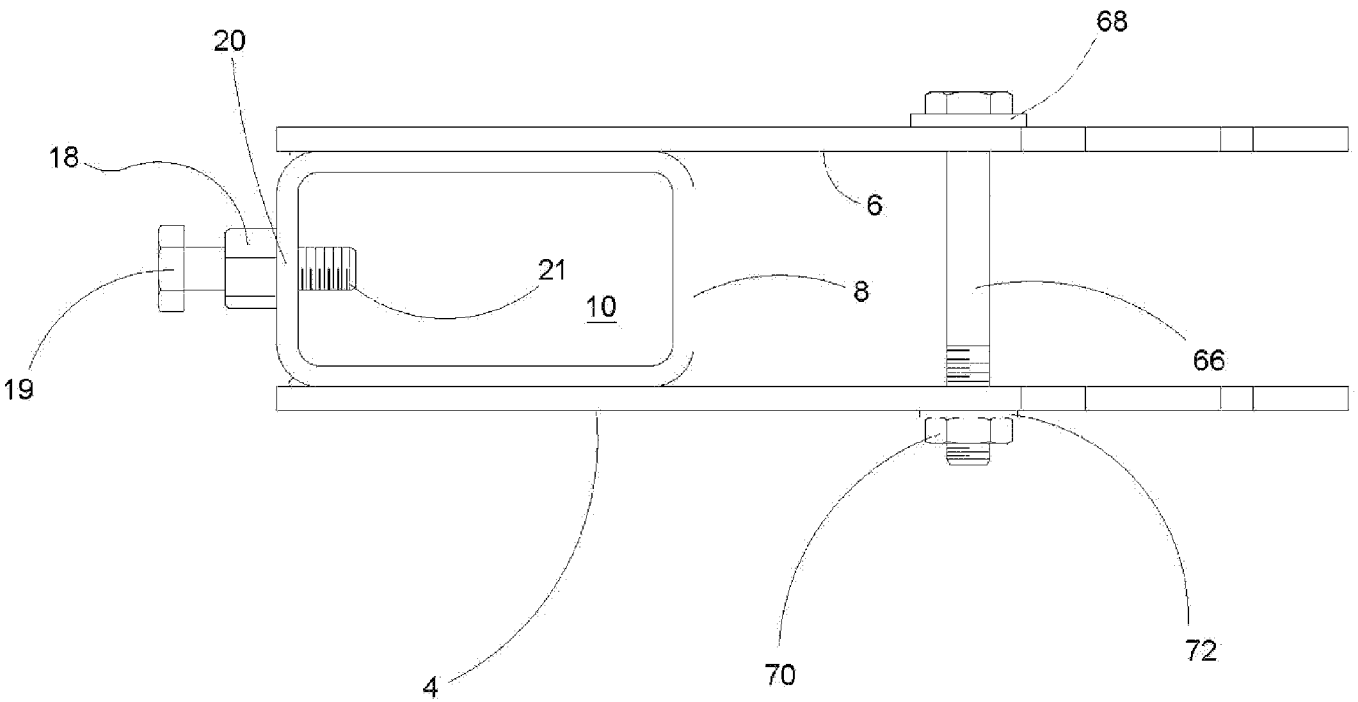
FIG. 4 is a view of disassembled medial quill section and clevis joint element of the machine depicted in FIG. 1.

Referring simultaneously to FIGS. 1 and 4, releasable slide stopping means are preferably fixedly attached to the medial quill section 8, such means preferably comprising set screw receiving apertures which extend through the proximal-most wall 20 of quill section 8. Such slide stopping means preferably further comprises helically threaded nuts 18 which are fixedly welded to the proximal-most outer surface of wall 20 of the quill section 8, such nuts 18 being positioned to concentrically overlie the apertures throung wall 20. Such preferred slide stopping means preferably further comprises helically threaded bolts or set screws 19, such bolts being threadedly received by and being mounted within threaded nuts 18, such bolts thence extending distally through the apertures throung wall 20. Upon lateral extension of the shaft 2 through bore 10 of the medial quill section 8, and upon right-handed tightening of set screws 19, the distal ends 21 of the set screws 19 advantageously extend distally and compressively to frictionally engage the proximal-most wall of shaft 2, such engagement selectively and fixedly positioning the medial quill section 8 at a desired mechanically advantageous location upon shaft 2. Referring further simultaneously to FIG. 6, such slide stopping means preferably further comprises helically threaded nuts 28 and set screws 30 which may similarly selectively secure the lateral quill section 25 at a desired location upon shaft 2. Referring further simultaneously to FIG. 10, the slide stopping means preferably further comprises helically threaded set screws 30A which may further similarly secure the laterally opposite quill section 27 at a desired location upon shaft 2.

Referring simultaneously to FIGS. 1, 6, and 7, a lateral anchor clamp is referred to generally by Reference Arrow 24. Such anchor clamp 24 preferably comprises an outer jaw plate 26 which is fixedly welded to, and which extends upwardly from the upper surface of the lateral quill section 25. Such jaw plate 26 preferably includes a quadruple of smooth walled bolt receiving apertures which receive a quadruple of laterally extending helically threaded bolt and washer combinations 40 and 42. The bolts 40 preferably extend laterally and axially through helical springs 50, and thence extend through a quadruple of smooth walled apertures which extend laterally through an inner jaw plate 32. Helically threaded nuts 38 are preferably fixedly welded in concentric alignment over such apertures, such nuts 38 threadedly receiving the bolts 40.

Referring further simultaneously to FIGS. 1, 6, and 7, the outer jaw plate 26 preferably further includes eight laterally extending helically threaded apertures, each of such apertures threadedly receiving a helically threaded tooth 44, each such tooth 44 presenting a weld seam engaging point 48. Preferably, the outer end of each of the threaded teeth 44 presents a hex key receiving depression. In the event that tooth points 48 become dulled or rounded through long use, such dulled teeth 44 may advantageously be threadedly withdrawn, and new sharp pointed teeth may advantageously be threadedly inserted in their place.

Referring further simultaneously to FIGS. 1, 6, and 7, the inner jaw plate 32 preferably presents an outwardly extending weld seam engaging ridge 36 and an underlying outwardly extending plate aligning ridge 34. Upon downward extension of an automobile's longitudinally extending uni-body weld seam (not within view) into the clamping space 37 defined by the inner ends of teeth 48 and the outer end of ridge 36, and upon subsequent tightening of bolts 40, the lateral anchor clamp 24 may effectively and securely hold such weld seam.

Referring simultaneously to FIGS. 1, 6, 7, 8, and 10, a laterally opposite anchor clamp 22 is preferably provided, such anchor clamp being attached to the laterally opposite quill section 27. The laterally opposite anchor clamp 22 is preferably substantially structurally identical to and functions substantially identically with the lateral anchor clamp 24.

Referring simultaneously to FIGS. 1, 2, 3, and 4, the medial quill section 8 preferably forms and supports means for pivotally attaching a proximal end of a pull force transmitting stem 56. Such means preferably comprises a pin, eye, and clevis joint. The clevis of such joint preferably comprises upper and lower apertured ear plates 4 and 6. The pin of such joint preferably comprises a bolt, nut, and washer combination 66, 68, 70, and 72, wherein the bolt 66 extends through vertically aligned apertures within plates 4 and 6. The eye of such combination preferably comprises a proximally oblongated slot 60 which extends vertically through the proximal end of stem element 56. Referring further to FIG. 3, the proximal end of the stem 56 is received between plates 4 and 6 while the bolt 66 extends vertically through the slot 60. The slot 60 preferably has distal and proximal slide stopping surfaces 62 and 64, such surfaces mechanically defining reciprocating longitudinal travel of the stem 56 with respect to the fixedly positioned bolt 66.

Figure 2:
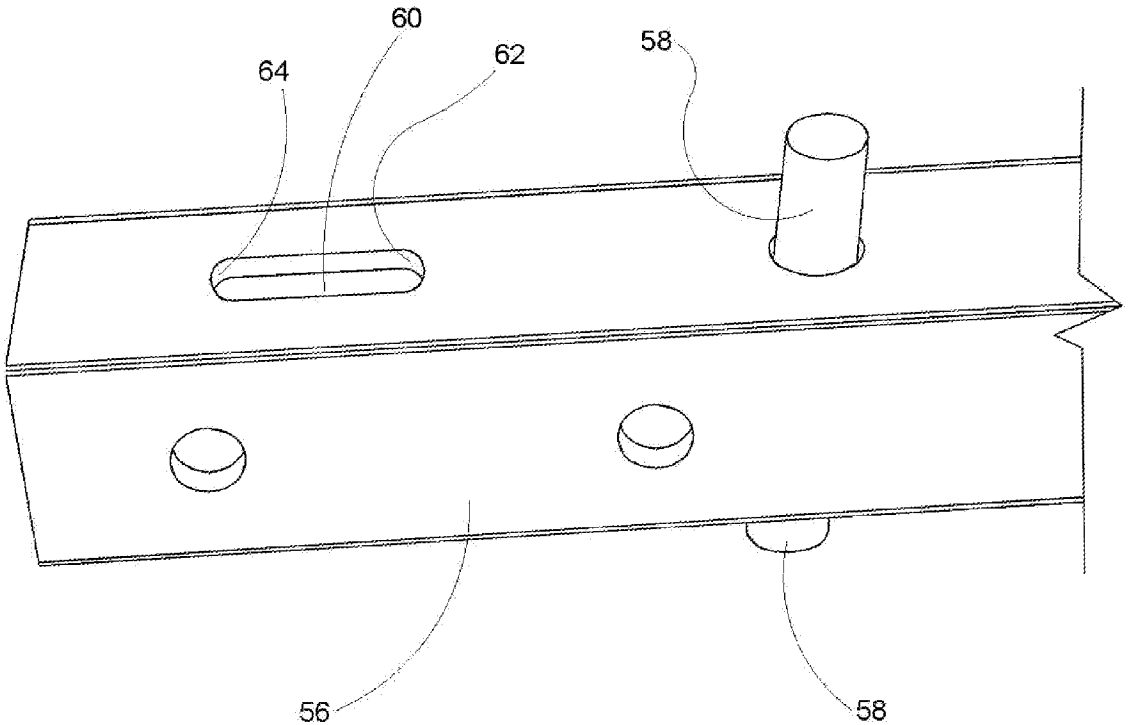
FIG. 2 depicts a disassembled proximal end of the telescoping stem element of the machine depicted in FIG. 1.

Referring to FIG. 3, the upper clevis plate 4 preferably presents a plurality of radially arrayed negative detents 12 while the lower clevis plate 6 preferably similarly presents a vertically aligned plurality of radially arrayed negative detents 14. Referring further simultaneously to FIG. 2, a singular positive detent is preferably provided, such positive detent preferably comprising vertically aligned upwardly and downwardly extending lugs 58.

Referring simultaneously to FIGS. 2 and 5, in operation of the depicted preferred clevis joint assembly, proximally directed body pulling load forces applied to stem 56 tend to drive the lugs 58 into a desired aligned set of negative detents 12 and 14. Such force simultaneously drives the distal surface 62 of slot 60 into the side wall of the bolt 66. The combination of such forces against such surfaces advantageously securely holds the stem 56 in a desired radially extended orientation. In order to change the radial positioning of the stem 56, the stem 56 may be slidably moved distally, causing the stem 56 to travel the longitudinal length of slot 60 until slot surface 64 rests against the side wall of bolt 66, such contact stopping such distally directed travel. At their distally extended positions, lugs 58 disengage from detents 12 and 14, allowing the stem 56 to freely pivot radially about bolt 66 to a new angular position wherein the lugs 58 may overlie a different vertically aligned pair of negative detents 12 and 14. Thereafter, the stem 56 may be slidably moved in the proximal direction, causing the lugs 58 to re-engage detents 12 and 14 at the newly selected angular orientation.

Referring to FIG. 1, the stem 56 preferably comprises square tube aluminum and is preferably telescoping, comprising a medial sleeve section 100 and a distal sleeve section 102. Sheer pin and alignable eye combinations 101 and 103 are preferably provided for selectively and fixedly positioning the medial section 100 of the stem 56 with respect to its proximal-most section. Similarly, the distal section 102 of the stem 56 is preferably selectively positionable with respect to the medial section 100 by means of pin and alignable eye fastener combination 105. Preferably, a stabilizing base 106 is fixedly welded to the under surface of the distal section 102 of the stem 56. By slidably positioning the medial and distal sections 100 and 102 of the stem 56 and by manipulating pins 103 and 105, the cantilevered length of the stem 56 may be advantageously tailored to suit a particular automobile and to a particular needed automobile body repair.

Referring further to FIG. 1, a pulling foot 114 preferably cantilevers upwardly from the extreme distal end of the stem 56. Preferably, the proximal end of the foot 114 is pivotally mounted to such distal end by means of a clevis 110 and a pivot pin 112 combination wherein the pivot pin 112 extends laterally through a laterally extending eye at the proximal end of the foot 114 and through the lateral and laterally opposite "ears" of the clevis 110.

Referring further to FIG. 1, foot extension means are preferably provided, such means preferably being connected operatively to and triangulating between the foot 114 and the stem 56. Preferably, the foot extension means comprises a one-way hydraulic cylinder 120 powered by a manually operated hydraulic pump 128, such pump and such cylinder preferably being interconnected by hydraulic line 126. As can be seen in FIG. 1, the foot 114 preferably comprises lateral and laterally opposite plates 113 and 115, such plates serving functionally as a clevis plates which receive and secure the upper end of hydraulic cylinder 120. A pin 118 which extends laterally through a pair eyes or pin receiving apertures 116 within plates 113 and 115 and through an eye (not depicted within view) at the upper end of cylinder 120 effectively pivotally attaches the upper end of such cylinder to the foot 114. A clevis and pin combination 108 and 109 similarly pivotally secures the lower end of the hydraulic cylinder 120 to the stem 56. Preferably, a lateral pair of the pin receiving apertures 116 which extend through the plates 113 and 115 of the foot 114 will, upon removal of the hydraulic cylinder 120 and upon complete flexion of foot 114 with respect to the stem 56, align with the apertures of the clevis 108, allowing either pin 109 or 118 to be reinserted to secure the foot 114 in a compact and collapsed storage position.

Referring to further to FIG. 1, a body pulling tie 122 preferably in the form of a heavy chain, as depicted, is preferably fixedly attached to a distal end of foot 114 by means of a pin 124.

Referring to FIG. 1, anchor clamps 22 and 24 may be secured to automobile's uni-body "hard point" weld seams (not depicted) at any of several selectable desired points along such seams. Referring further simultaneously to FIGS. 6 and 10, sliding and selectively locking positioning of the lateral and laterally opposite quill sections 25 and 27, along with their anchor clamps 24 and 22, allows such clamps to be securely engaged upon numerous makes of automobiles having varyingly spaced weld seams. In addition to the selective lateral and longitudinal positioning capability provided by the anchor clamps and their quill sleeves, the central sliding pivot joint provides further flexibility in configuring mechanically advantageous progressive body straightening pulls. The entire assembly depicted in FIG. 1 quickly and easily breaks down for compact storage or for transportation.

Referring to FIG. 8, lateral and laterally opposite extension anchor clamps 82 and 80 may be suitably provided, such clamps preferably being configured similarly with anchor clamps 22 and 24, with the exceptions that, referring further to FIGS. 9 and 10, quill sections or slide sleeves 83 and 86 extend in alignment with extension anchor clamps 82 and 80 as opposed to a perpendicular orientation. Lateral and laterally opposite extension arms 76 and 74 may also be provided, the lateral and laterally opposite extension clamps 82 and 80 being securable upon the distal ends thereof by helically threaded set screws 85 and 88.

Referring simultaneously to FIGS. 6, 8, 9, and 10, attachment pins or lugs 52 and 52A may be respectively fixedly welded to the proximal—most surfaces of the lateral and laterally opposite quill sections 24 and 22, each of such lugs respectively presenting a laterally extending attachment pin receiving channel. Preferably, the lateral and laterally opposite extension arms 76 and 74 comprise hollow bored rectangular tubing allowing the proximal ends of such tubes to be extended over lugs 52 and 52A in a manner common to pin and socket joints. In particular, referring to FIGS. 8 and 10, upon slidably moving extension arm 74 over lug 52A, lock pin 75 may be extended laterally through aperture 79 and through lug 52A. Thereafter, lock pins 77 and 75 may be extended laterally therethrough for securely mounting the extension clamp assemblies. In operation, the lateral and laterally opposite extension clamps 82 and 80 mount to and may securely engage the same "hard point" welding seams that are engaged by anchor clamps 24 and 22.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

The invention claimed is:

1. An automobile body repair machine comprising:

(a) a quill and shaft assembly, the quill comprising lateral and medial quill sections;

(b) slide stopping means fixedly attached to the lateral and medial quill sections;

(c) a lateral anchor clamp fixedly attached to the lateral quill section;

(d) an oppositely lateral anchor clamp;

(e) means for mounting the oppositely lateral anchor clamp upon the shaft;

(f) a stem having a distal end;

(g) attaching means cantilevering the stem from the medial quill section;

(h) a foot having a distal end;

(I) pivotal attaching means pivotally cantilevering the foot from the stem's distal end;

(j) extension means connected operatively to the foot; and (k) a body damage pull tie fixedly attached to the distal end of the foot.

2. The automobile body repair machine of claim 1 wherein the means for mounting the oppositely lateral anchor clamp upon the shaft comprises an oppositely lateral quill section, the slide stopping means being further fixedly attached to the oppositely lateral quill section.

3. The automobile body repair machine of claim 2 further comprising lateral and oppositely lateral extension clamps, and extension clamp attaching means respectively removably attaching the lateral and oppositely lateral extension clamps to the lateral and oppositely lateral quill sections.

4. The automobile body repair machine of claim 3 wherein the extension clamp attaching means comprises lateral and oppositely lateral pin and socket joints.

5. The automobile body repair machine of claim 2 wherein the slide stopping means comprises helically threaded set screw and set screw receiving aperture combinations.

6. The automobile body repair machine of claim 1 wherein the attaching means is adapted for alternately permitting and resisting pivoting.

7. The automobile body repair machine of claim 6 wherein the attaching means comprises a pin, eye, and clevis joint.

8. The automobile body repair machine of claim 7 wherein the pin, eye, and clevis joint comprises a positive detent and plurality of radially arrayed negative detents combination or a negative detent and plurality of radially arrayed positive detents combination.

9. The automobile body repair machine of claim 8 wherein the pin, eye, and clevis joint's eye is proximally oblongated for detents disengaging extension of the stem.

10. The automobile body repair machine of claim 1 wherein the shaft comprises a metal tube having a rectangular cross-sectional shape.

11. The automobile body repair machine of claim 1 wherein each clamp among the lateral and oppositely lateral anchor clamps comprises at least a first jaw plate, each at least first jaw plate comprising a plurality of teeth.

12. The automobile body repair machine of claim 11 wherein each at least first jaw plate has a plurality of helically threaded apertures extending therethrough, and wherein each tooth among the pluralities of teeth is helically threaded, each tooth being threadedly mounted within one of the apertures among the pluralities of helically threaded apertures.

* * * * *